US007617787B2

(12) United States Patent
Marcangelo

(10) Patent No.: US 7,617,787 B2
(45) Date of Patent: Nov. 17, 2009

(54) PROGRAMMABLE TUCKING ATTACHMENT FOR A SEWING MACHINE AND METHOD

(75) Inventor: Steven Marcangelo, N. Chelmsford, MA (US)

(73) Assignee: L&P Property Management Company, South Gate, CA (US)

( * ) Notice: Subject to any disclaimer, the term of this patent is extended or adjusted under 35 U.S.C. 154(b) by 724 days.

(21) Appl. No.: 11/278,491

(22) Filed: Apr. 3, 2006

(65) Prior Publication Data

US 2006/0180068 A1 Aug. 17, 2006

Related U.S. Application Data

(63) Continuation of application No. 11/047,103, filed on Jan. 31, 2005, now Pat. No. 7,021,227, which is a continuation of application No. 10/277,394, filed on Oct. 22, 2002, now Pat. No. 6,889,622.

(51) Int. Cl.
*D05B 1/00* (2006.01)

(52) U.S. Cl. ..... 112/475.06; 112/2.1; 112/144; 112/470.01; 112/470.04; 112/470.05

(58) Field of Classification Search ..... 112/2.1, 112/132, 134, 135, 144, 145, 146, 470.04, 112/470.05, 470.16, 470.27, 475.04, 475.06, 112/475.08; 5/690, 716, 717, 737, 739; 223/28, 223/30

See application file for complete search history.

(56) References Cited

U.S. PATENT DOCUMENTS 1,293,725 A 2/1919 De Voe
1,911,190 A 5/1933 Harrison et al.
2,642,828 A 6/1953 Carroll
2,749,858 A 6/1956 Campbell et al.
3,918,376 A 11/1975 Nishiwaki et al.
4,014,273 A 3/1977 Kosakai
4,014,274 A 3/1977 Kosakai
4,073,246 A 2/1978 Crawford et al.
4,079,682 A 3/1978 Nishiwaki
4,157,688 A * 6/1979 Forrester ..... 112/132
4,353,774 A 10/1982 Zaehringer
4,606,287 A 8/1986 Papajewski et al.
4,616,584 A 10/1986 Vartoukian et al.
5,029,542 A 7/1991 Ferguson
5,031,554 A 7/1991 Glenn (Continued)

OTHER PUBLICATIONS

EPO, Supplementary European Search Report, International Application No. PCT/US2003/032210.

*Primary Examiner*—Gary L Welch
*Assistant Examiner*—Nathan E Durham
(74) *Attorney, Agent, or Firm*—Wood, Herron & Evans, LLP

(57) ABSTRACT

A tucking attachment for a sewing machine having a tucking blade with one end positioned adjacent material and a tucking blade drive with an output shaft mechanically coupled to the tucking blade. A control, connected to the tucking blade drive, is operable to command displacement to form a tuck in the material adjacent a presser foot of the sewing machine. Thereafter, the sewing machine is operated to sew a number of stitches in the tuck, and the tucking blade is then retracted. Repeating the above cycle of operation permits successive tucks of different lengths to be formed in the material.

9 Claims, 10 Drawing Sheets

U.S. PATENT DOCUMENTS 5,114,056 A 5/1992 Frye
5,285,542 A 2/1994 West et al.
5,315,942 A 5/1994 Pantusco et al.
5,562,058 A 10/1996 Niino
5,586,511 A 12/1996 Porter et al.
5,611,468 A 3/1997 Schulze et al.
5,769,014 A 6/1998 Mori
5,769,015 A 6/1998 Kato
5,771,829 A 6/1998 Schebler et al.
5,782,190 A 7/1998 Porter et al.
5,915,319 A * 6/1999 Price et al. ..... 112/470.16
5,966,758 A 10/1999 Karam
5,983,814 A * 11/1999 Block ..... 112/2.1
6,202,579 B1 3/2001 Olewicz et al.
6,291,039 B1 9/2001 Combe et al.
6,530,335 B1 3/2003 Halfmann et al.
6,574,815 B2 6/2003 Freeman et al.
6,802,271 B2 10/2004 Oxley et al.
6,834,603 B1 12/2004 Price et al.
2002/0144352 A1 10/2002 Freeman et al.

* cited by examiner

PROGRAMMABLE TUCKING ATTACHMENT FOR A SEWING MACHINE AND METHOD

This application is a Continuation of U.S. application Ser. No. 11/047,103 filed on Jan. 31, 2005, now U.S. Pat. No. 7,021,227, which is a continuation of U.S. application Ser. No. 10/277,394, filed on Oct. 22, 2002, now U.S. Pat. No. 6,889,622, the entirety of which applications are hereby incorporated by reference herein.

FIELD OF THE INVENTION

This invention relates generally to sewing machines and more particularly, to a method and apparatus for tucking fabric in the process of sewing mattresses.

BACKGROUND OF THE INVENTION

The sewing of various components of a mattress together to form a finished product presents several sewing challenges. One such challenge is the sewing of the components at their respective corners. For example, pillow-top mattresses are constructed to appear as though a comforter or pillow has been placed on a conventional mattress to provide a more luxurious and comfortable appearance. The pillow-top is connected to the upper decking of the mattress by an intermediate gusset of folded material. Several different techniques are known to sew the edge of the pillow-top corners to corresponding corners of gusset so that the resulting sewn corners have a consistent and pleasing appearance. However, all of those techniques require various manual operations, and therefore, incorporating the gusset into pillow-top mattresses normally makes them more expensive to manufacture than conventional mattresses.

It is known to miter the gusset to form the gusset around a corner. With one system, the operator cuts an extended length of previously formed gusset material at measured locations where the corners of the cover are expected to be; and the mitered corner is formed on the gusset material before it is attached to the panel. However, due to the nature and construction of the mattress cover material and of the gusset material, often the gussets and panels shrink or change shape at differing rates if left to sit, thus somewhat altering the location of the pre-mitered corner on the gusset material with respect to the corner on the mattress panel. This change occurs more frequently when the gusset is manufactured well in advance of the date of assembly of the mattress cover. Since the mitered corners on the gusset are not aligned precisely with the corners of the mattress cover panel, an accommodation has to be made by the operator at the time the gusset is attached to the mattress cover panel, such as by gathering the material or stretching where necessary to properly position the mitered corner. This adjustment results in extra operator time, as well as the possibility that the mitered corner is not properly positioned, or that the corner exhibits an uneven or undesired appearance. Even where the operator is able to properly position the mitered corner, the required stretching or gathering of the material produces a mattress cover which does not have the desired look and which might not be acceptable to all purchasers.

With another known system, a single machine is provided for making the gusset and for attaching the flange material. This machine folds the gusset, stitches it together in its folded condition, and secures the flange material to the gusset. The finished gusset is then cut into lengths and bound to a mattress panel. In conjunction with that operation, a mitering station is provided closely adjacent the binding machine. When it is desired to miter a corner of the gusset, as the operator approaches a corner of the mattress cover panel, the binding machine is stopped, and the operator measures exactly the distance from that point to the corner of the panel. An equivalent distance is marked on the gusset material. The operator then pulls that part of the gusset material over to the closely adjacent mitering station. The gusset material is first folded transversely at that point. Next, two stitches are applied by a sewing machine to the gusset from the folded edge inwardly. Each stitch is at a 45 degree angle with respect to the folded edge of the gusset, so that the stitches form a 90 degree angle with respect to each other. The sewing machine preferably is preprogrammed to stitch precisely the desired number of stitches needed for the miter. All the operator must do is wait until the stitches have completed, rotate the gusset material through 90 degrees and start the machine again. Thereafter, the triangular section defined by the stitches and the folded edge is cut out of the gusset material either automatically, or manually, and the gusset material is removed from the mitering station. While more automated, the above operation still requires numerous steps by the operator to form a corner during the process of attaching the gusset to another piece.

Therefore, there is a need for a still further improved process for reliably securing a gusset to a mattress component, for example, an upper deck of a mattress.

Another challenge in sewing bedding components at their respective corners arises when attaching an upper decking to a border of a bedding foundation, for example, a box spring. With one known process, an edge of the upper decking material is sewn to an edge of the bedding foundation material along the outer edge of the bedding foundation. The joint between the corner of the upper decking can be precut so that there is no or minimal excess material at the corner. If the corners in the upper decking material are not precut, the machine operator must gather the material to accommodate the extra material at the corners. Unless the operator is particularly skilled, sometimes the result is a rather uneven look, since the bedding foundation components are unwieldy and difficult to maneuver around the corners. Further, since the sewn joint is at the edge of the bedding foundation, the upper decking material is often visible even after a mattress is set on top of the bedding foundation.

To provide a better finished appearance, it is also known to attach the bedding foundation border material to the upper decking material at a location inside the outer edge of the bedding foundation, for example, 3-4 inches inside the bedding foundation edge. However, to provide a desirable finished appearance, it is necessary to miter the bedding foundation border material as it is formed around the corners of the bedding foundation. Mitering of the bedding foundation border material is accomplished by techniques similar to those described above. While improving the appearance of the finished bedding foundation, the additional labor required substantially increases the manufacturing cost of the bedding foundation.

Therefore, there is also a need to further improve the process of attaching the upper decking material to the border material of a bedding foundation.

SUMMARY OF THE INVENTION

The present invention provides a tucking attachment for a sewing machine that facilitates sewing one material to another around a corner. The tucking attachment of the present invention permits tucks of different lengths to be formed in a material. Therefore, the tucking attachment of the present invention provides great flexibility in controlling the fullness of material in sewing around a corner as well as the appearance and style of the finished material. Further, with the tucking attachment of the present invention, the formation of each tuck is automatically and precisely controlled; and therefore, the formation of tucks around a corner is repeatable from corner to corner. The tucking attachment of the present invention automatically creates material tucks so that the material can be guided to sew a seam around a corner with a minimum of operator intervention; and therefore, high quality material corners can be sewn without substantially increasing the manufacturing costs.

The tucking attachment of the present invention is especially useful in joining components used to make a mattress or a bedding foundation. The capability of programming different lengths of successive tucks in sewing the corners of two components together permits a bedding manufacturer to create appearances that are different and unique to the manufacturer. Further, since operator intervention is not required in the formation of the individual material tucks, the operator can concentrate on overall material handling. The net result is a material tucking and sewing process that is more efficient and less stressful and tiring on the operator while producing a more consistent and higher quality product.

According to the principles of the present invention and in accordance with the described embodiments, the invention provides a tucking attachment for a sewing machine. The tucking attachment has a tucking blade with one end positioned adjacent the material and a tucking blade drive with an output shaft mechanically coupled to the tucking blade. A control, connected to the tucking blade drive, has a memory storing programmable displacements of the tucking blade and is operable to command the tucking blade drive to move the tucking blade through a programmable displacement to form a tuck in the material adjacent a presser foot of the sewing machine. Thereafter, the control is operable to command the tucking blade drive to move the tucking blade in an opposite direction. Thus, repeating the above cycle of operation permits successive tucks of different lengths to be formed in the material, thereby facilitating sewing a curved seam in the material.

In one aspect of this invention, the tucking blade and tucking blade drive are pivotally mounted to a support attached to the sewing machine, thereby allowing the tucking blade and tucking blade drive to be pivoted to an open position that allows more access to the sewing machine presser foot and needle.

In another embodiment of the invention, a method is provided for forming a tuck in a stitchable material on a sewing machine having a presser foot for holding the material and a needle for sewing the material held by the presser foot. First, the material is located beneath the presser foot; and then, a tucking blade is moved into contact with the material of the presser foot. Thereafter, the tucking blade is moved through a programmable displacement toward the presser foot to form a tuck in the material below the presser foot. The sewing machine is then operated to sew a number of stitches through the tuck, the tucking blade is retracted. In one aspect of the invention, that process is repeated until a desired number of tucks are formed.

These and other objects and advantages of the present invention will become more readily apparent during the following detailed description taken in conjunction with the drawings herein.

DETAILED DESCRIPTION OF THE INVENTION

Figure 1:
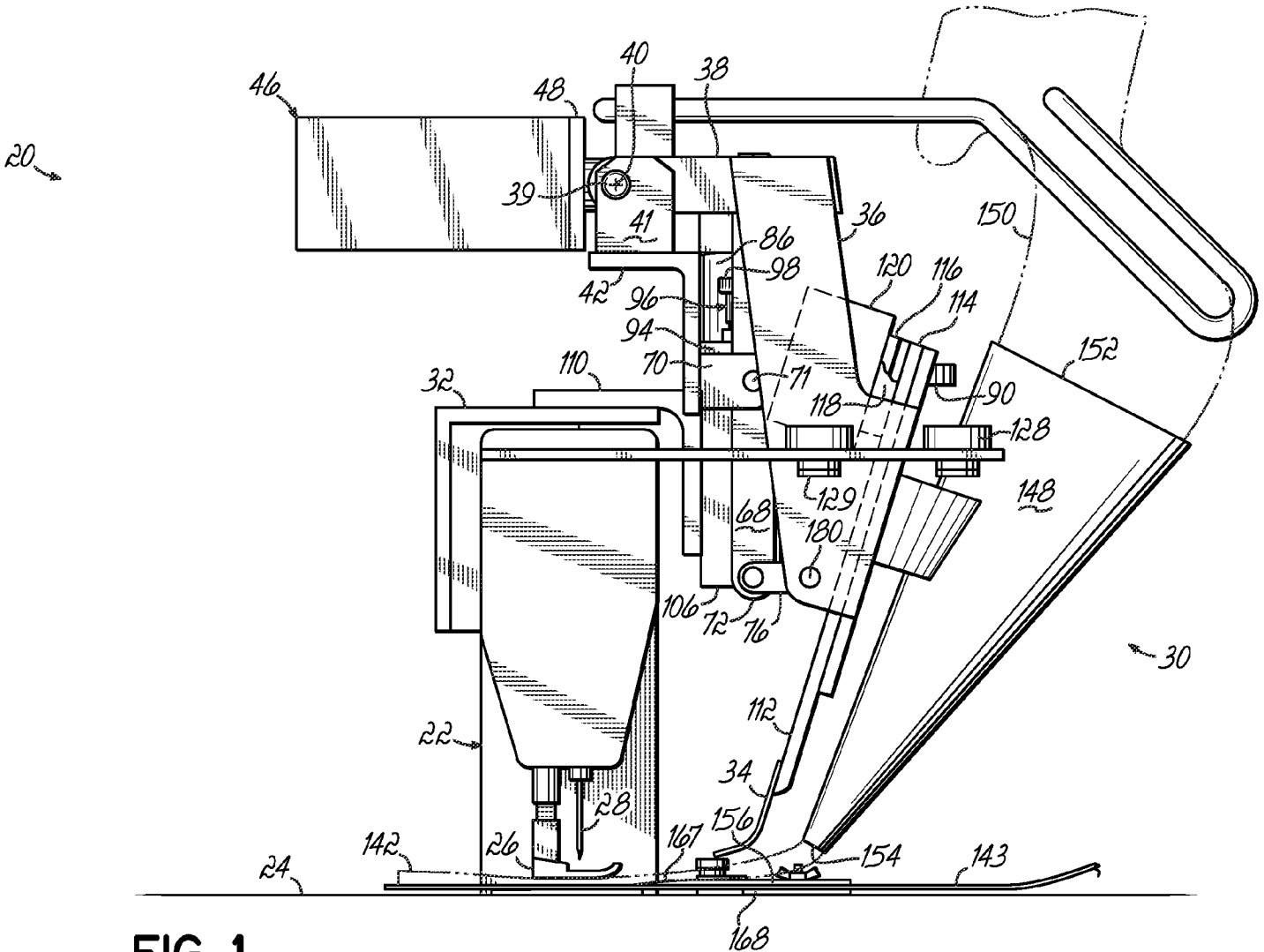
FIG. 1 is an end view of a sewing system illustrating a tucking attachment in accordance with the principles of the present invention.

Referring to FIG. 1, a sewing system 20 has a sewing machine 22 mounted in a base plate 24 in a known manner. The sewing machine includes a presser foot 26 and a needle 28 that is reciprocated and carries a needle thread and a bobbin thread in a known manner. The sewing machine 22 is a commercial sewing machine that performs lock stitching. Lock stitching is a known technique of interlacing a needle thread and bobbin thread, which will not be further described here. A tucking attachment 30 is mounted on the sewing machine by means of mounting brackets 32, 110. The tucking attachment 30 of FIG. 1 includes a tucking blade 34 that is mounted in a tucking arm 36. The tucking arm 36 has an upper end 38 pivotally mounted to a pivot pin or trunnion 39 that is supported between a pair of opposed bearing blocks 41, 60(FIG. 2) that are mounted on a support bracket 42.

A tucking blade drive 44 is also mounted to the support bracket 42 and is operative to provide a pivoting motion to the tucking arm 36, thereby causing the tucking blade 34 to form tucks in a material in a manner as will subsequently be described. The tucking blade drive 44 is powered by an actuator 46, for example, an AC servomotor. The servomotor 46 is connected to a generally U-shaped motor bracket 48. The motor bracket 48 has opposed legs 50, 52 that extend outward from the motor 46 in a direction generally parallel to a motor output shaft formed as a ball screw 54. The opposed legs 50, 52 are pivotally mounted on respective opposed pivot pins 56, 58 that, in turn, are supported by respective opposed support blocks 60, 62.

A ball nut 64 is mounted on the ball screw 54 and is pivotally mounted on opposed pivot pins 65 supported by a clevis 66 formed at one end of a drive link 68. The drive link 68 is rotatably mounted on a pivot pin 71 within a pair of opposed bearing blocks 70 extending from the support bracket 42. The lower end 72 of the drive link 68 is pivotally mounted within an upper end 74 of a shackle 76. A shackle lower end 78 is pivotally mounted to a shaft 80 that is attached to the tucking arm 36. Thus, as the servomotor 46 is operated to move the ball nut 64 along the ball screw 54 toward the motor 46, the drive link 68 is rotated clockwise as viewed in FIG. 2 with respect to the pivot pin 71. The clockwise rotation of the drive link 68 imparts a clockwise rotation of the tucking arm 36 with respect to the pivot axis 40, thereby moving the tucking blade 34 (FIG. 1) away from the presser foot 26. Reversing the operation of the servomotor 46 moves the ball screw 64 away from the motor 46, thereby imparting a counterclockwise rotation to the drive link 68 with respect to the pivot axis 82 as well as the tucking arm 36 with respect to the pivot axis 40. That counterclockwise rotation of the tucking arm 36 moves the tucking blade 34 toward the presser foot 26. As will be appreciated, the displacement of the ball nut 64 along the ball screw 54 is programmably controllable and therefore, the stroke of the tucking blade 34 and length of the resulting material tuck is also programmably controllable.

Figure 2:
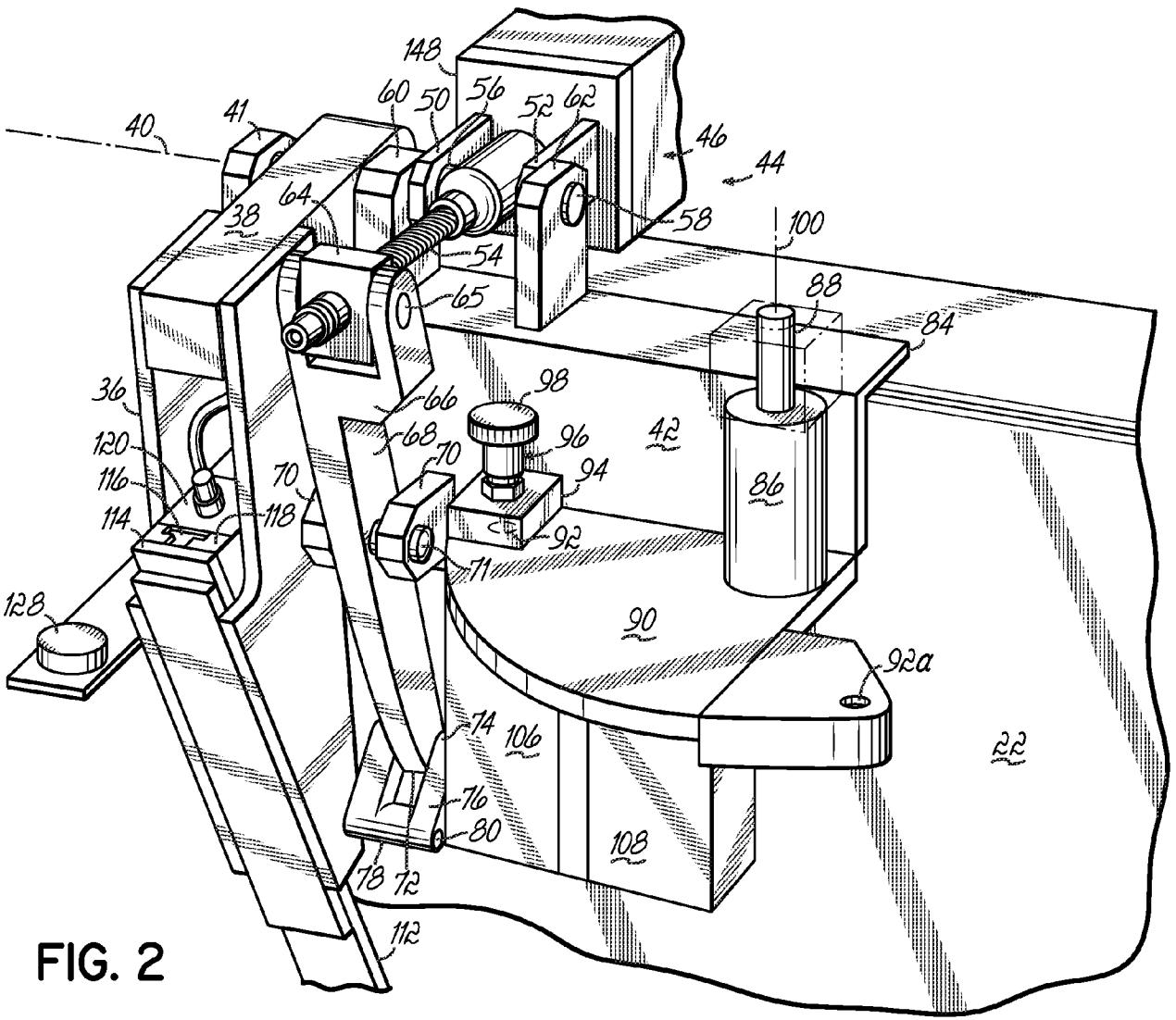
FIG. 2 is partial perspective view illustrating a feed drive for the tucking attachment of FIG. 1.

As shown in FIG. 2, the support bracket 42 is connected at its inner end 84 to a bushing 86 that is rotatably mounted over shaft 88. The shaft 88 is fastened at its lower end to an arcuate support plate 90 having a plurality of detents 92. A locking pad 94 extends horizontally from a lower side of the support bracket 42 over the support plate 90. A spring loaded release pin 96 is mounted to the locking pad, and the release pin 96 is biased such that a lower end of the release pin is disposed in one of the detents 92. That detent is located such that the support bracket 42 and all of the tucking attachment components attached thereto are located at a desired operating position. The release pin 96 has a knob 98 that facilitates an operator raising the release pin out of its detent. With the release pin 96 in its raised position, the bracket 42 and all of the tucking attachment components supported thereon can be rotated counterclockwise as viewed in FIG. 2 with respect to an axis of rotation 100 defined by the shaft 88. The support plate 90 provides the necessary support for the support bracket 42 and associated tucking attachment components as the support bracket 42 is rotated. Upon rotating the support bracket 42 about 90° to an open position shown in FIG. 4, the release pin 96 is biased into a detent 92*a* (FIG. 2), thereby locking the tucking attachment in a retracted position. The retracted position provides the operator unfettered access to the presser foot 26 and needle 28. Raising the release pin 96 out of the detent 92*a* permits the support bracket 42 and associated tucking attachment components to be rotated clockwise back to the desired operating position.

Figure 4:
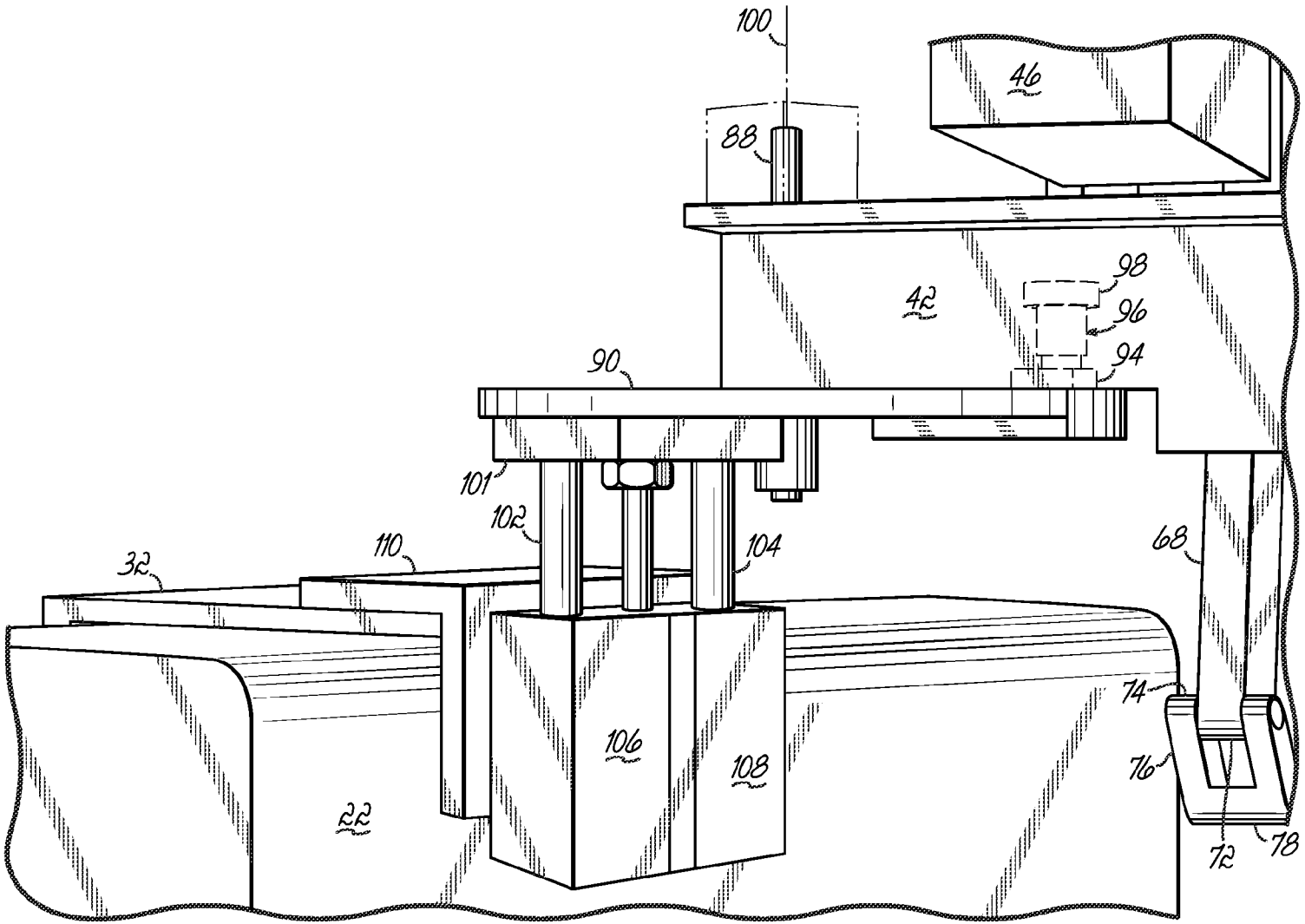
FIG. 4 is partial perspective view illustrating elevate cylinders for the tucking attachment of FIG. 1.

Referring to FIG. 4, the arcuate support plate 90 is mounted on and supported by a drive plate 101 that, in turn, is mounted at the distal ends of cylinder rods 102, 104 of respective cylinders 106, 108. Operation of the cylinders 106, 108 is effective to raise or lower the drive plate 101, the support plate 90, the support bracket 42 and the associated components of the tucking attachment 30. The cylinders 106, 108 are attached to a right angle mounting bracket 110 that, in turn, is supported by the sewing machine 22 and is attached to a bracket 32.

Referring back to FIG. 1, the tucking blade 34 is mounted at a lower end of a tucking blade mounting bar 112 that, in turn, is slidably supported within the tucking arm 36. An upper end 114 of the mounting bar 112 is attached to a cylinder rod 116 supported within a guide 118. Thus, by operating cylinder 120, an operator is able to move the cylinder rod 116 and tucking blade mounting bar 112 up and down, thereby respectively retracting and advancing the tucking blade 34 with respect to the presser foot 26.

Figure 5:
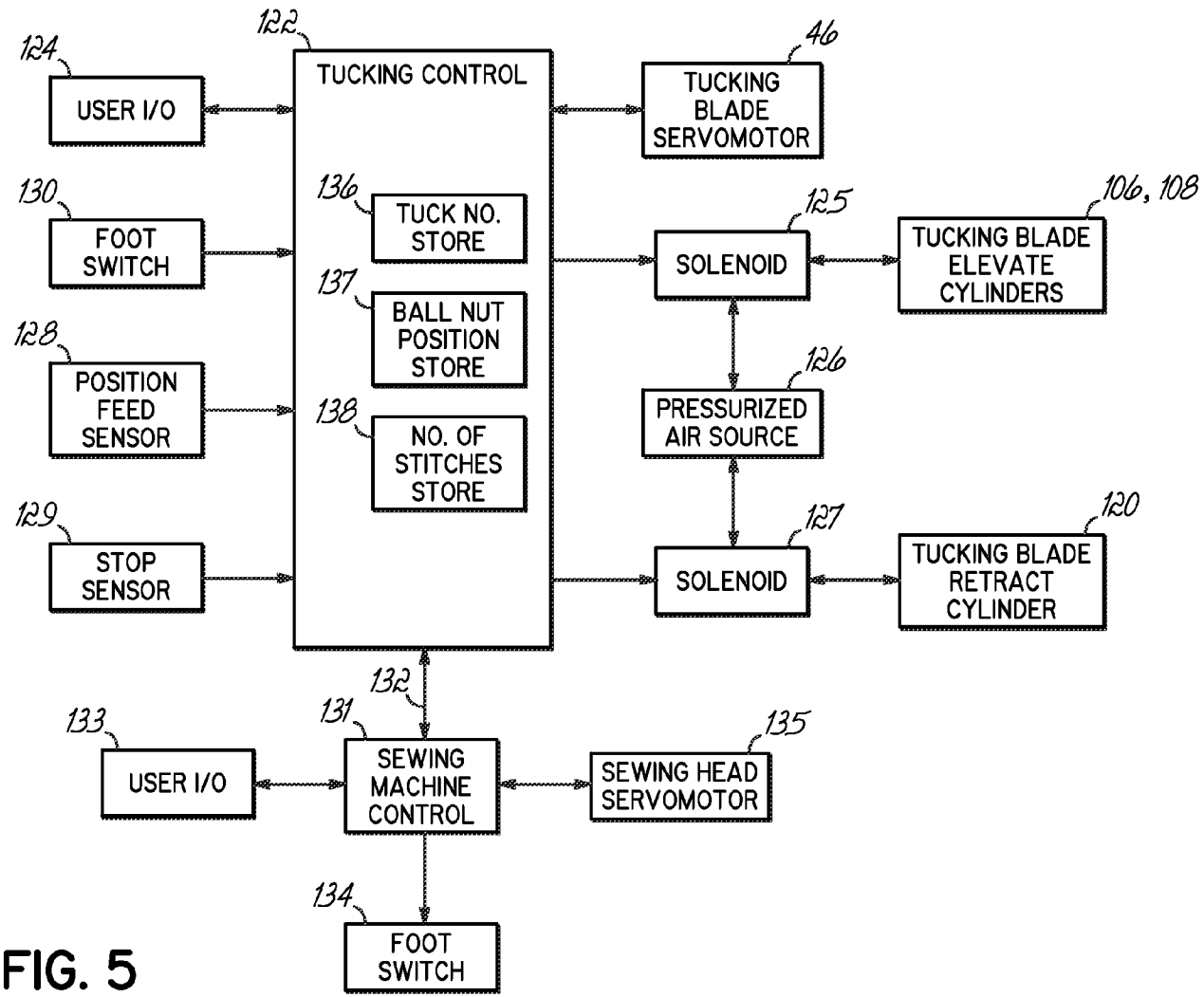
FIG. 5 is schematic block diagram illustrating a control for the tucking attachment of FIG. 1.

Referring to FIG. 5, the operation of the tucking plate attachment 30 is controlled by a programmable control 122, for example, a commercially available programmable logic controller. The control 122 includes a user input/output ("I/O") interface 124 that provides various user operable input devices, for example, pushbuttons, switches, etc., as well as various sensory perceptible output devices, for example, lights, a visual display such as an LCD screen, etc. The user I/O 124 permits the user to command the operation of individual servomotors and cylinders connected to outputs of the control 122. Thus, by actuating an input device on the user I/O 124, an operator can command the control 122 to provide an output signal to change a state of a solenoid 125. Changing the state of solenoid 125 changes the porting of pressurized air from the air source 126 to the tucking blade elevate cylinders 106, 108, thereby causing the cylinders 106, 108 to raise or lower the respective cylinder rods 102, 104 (FIG. 4). In a similar manner, an operator uses the user I/O 124 to command the control 122 to provide output signals to the solenoid 127 causing the tucking plate retract cylinder 120 to retract or advance the tucking blade 34. In addition, the user I/O permits an operator to enter tucking operation parameters, for example, the number of tucks to be placed around a corner, the length of each tuck and the number of stitches between the tucks.

The tucking control 122 receives inputs from position feed and stop sensors 128, 129, respectively, and a foot switch 130 that is used by an operator to activate a tucking cycle. The tucking control 122 is connected to a sewing machine control 131 via digital I/O lines 132 that permit the tucking control 122 to provide operating commands to the sewing machine control 131. The sewing machine control receives operator commands via a user I/O 133 and a foot switch 134 and provides output signals to operate a sew head servomotor 135 and other devices on the sewing machine 22 in a known manner. The tucking control 122 has a ball nut position store 136 that is used to store the desired positions of the ball nut 36 that correspond to the tuck lengths input by the operator, thereby determining the length of each of the tucks.

Figure 6:
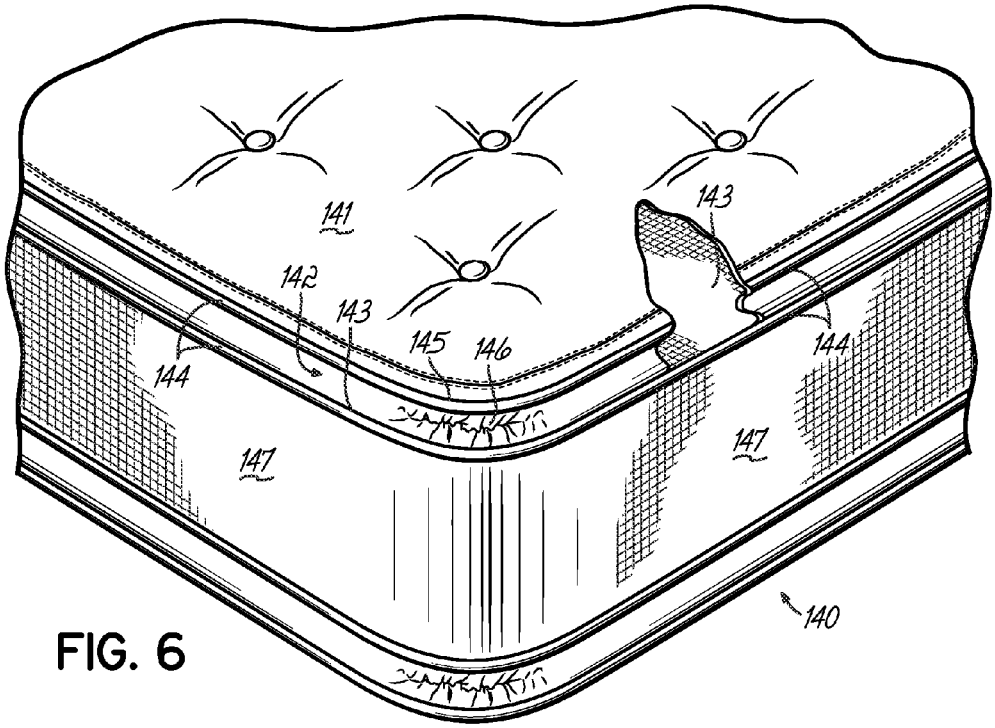
FIG. 6 is partial perspective view of a corner of a mattress having a pillow top and representing one application for the tucking attachment of FIG. 1.

Referring to FIG. 6, a mattress 140 has a pillow top 141 sewn to one edge of a gusset 142 that, in turn, has another edge sewn to an upper decking panel 143 of a mattress body 147. The mattress body 147 is often of an innerspring construction. As earlier discussed, sewing the pillow top 141, gusset 142 and upper decking panel 143 together is relatively easy along the straight edges 144 of the mattress body 147. However, sewing the gusset 142 around a corner 145 of the mattress body 147 is more difficult, and various known techniques for sewing the gusset 142 around the corner have been previously discussed. With the present invention, tucks 146 are formed in the gusset material 142, so that as the upper decking material 143 and gusset material 142 are guided to sew a seam around the corner 145, the gusset appearance is predictable, pleasing and repeatable. With this gusset sewing application, referring to FIG. 1, a material folder 148 is mounted on an outer surface of the tucking arm 36. A strip of unfolded material strip 150 is manually fed into an inlet end 152, through the folder 148 and past an outlet end 154. As the material strip 150 passes through the folder 148 it is folded over itself to form to opposed sides, and that folded configuration of the folded material 150 is referred to herein as the gusset 142.

Figure 7:
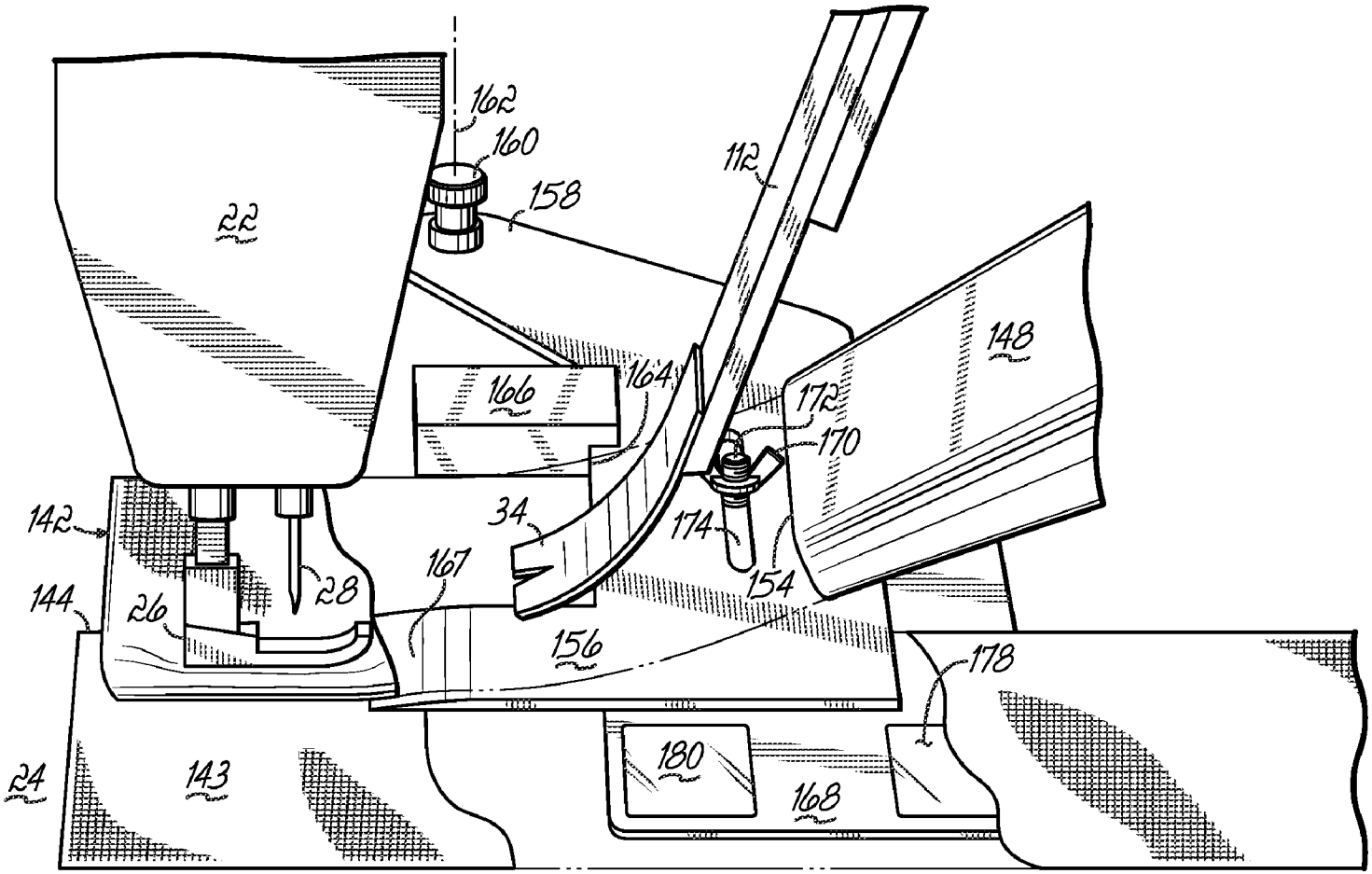
FIG. 7 is partial perspective view of an anvil and decking guide used in conjunction with the tucking attachment of FIG. 1.

Referring to FIG. 7, the tucking attachment 30 further includes an anvil 156 that is secured at an inner end 158 by a locking screw 160. Loosening the locking screw 160 permits the anvil 156 to be pivoted counterclockwise, away from the presser foot 26, about an axis of rotation 162 defined by the locking screw 160. When the anvil 156 is pivoted clockwise back to its illustrated position, it is located by a positive stop surface 164 on stop block 166. The locking screw 160 is then tightened to secure the anvil 156 in place. The anvil 156 has an inclined surface 167 that provides a subjacent support for the gusset material as the tucking blade 34 forms a tuck in the gusset. A decking guide 168 is mounted below the anvil 156 by means of a locking nut 170 and screw 172 slidably mounted in slot 174. By loosening the locking nut 170, the decking guide 168 can be slid to different positions in a direction parallel to the slot 174. The decking guide is positioned such that when an edge of the gusset material is aligned with an inner edge (not shown) of the decking guide, the two sides of the folded gusset will be of equal widths.

In use, an example of a first application is sewing a gusset 142 (FIG. 6) to upper decking material 143. After a desired tucking pattern and style have been determined, the operator uses the user I/O 124 to input parameters relating to the number of tucks to be used to form the corner, the length or size of each tuck and the number of stitches to be sewn between tucks. Those parameters are stored in a tuck number store 136, ball nut position store 137 and number of stitches store 138. As will be appreciated, the length of each tuck can be readily converted to a ball nut position.

Figure 3:
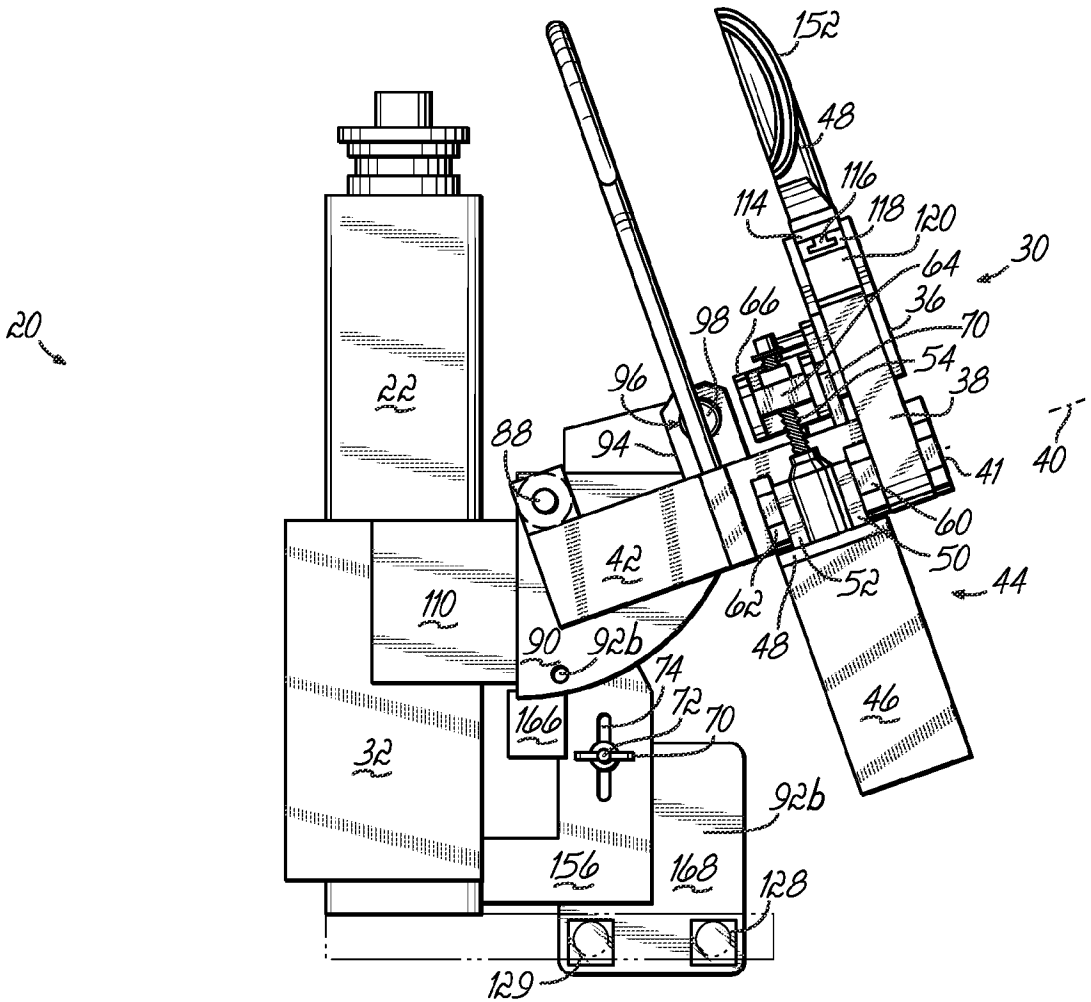
FIG. 3 is a top plan view of the sewing system illustrating the tucking attachment of FIG. 1 pivoted to its open position.

First, in a manner previously described, the operator raises the release pin 96 (FIG. 2) so that the tucking attachment 30 can be pivoted away from the presser foot 26 (FIG. 3), thereby giving the operator full access to the needle 28. The needle 28 is then threaded with the needle and bobbin threads in a known manner. Referring to FIG. 7, the upper decking material 143 is fed over the base plate 24 and decking guide 168 and beneath the anvil 156. The decking material 143 is oriented such that one of the straight edges 144 is located beneath the presser foot at a point where the sewing operation is to begin. The tucking attachment 30 is then pivoted clockwise until the release pin 96 enters a detent 92*b* (FIG. 3), thereby locating the tucking attachment 30 at its operating position.

Figure 8A:
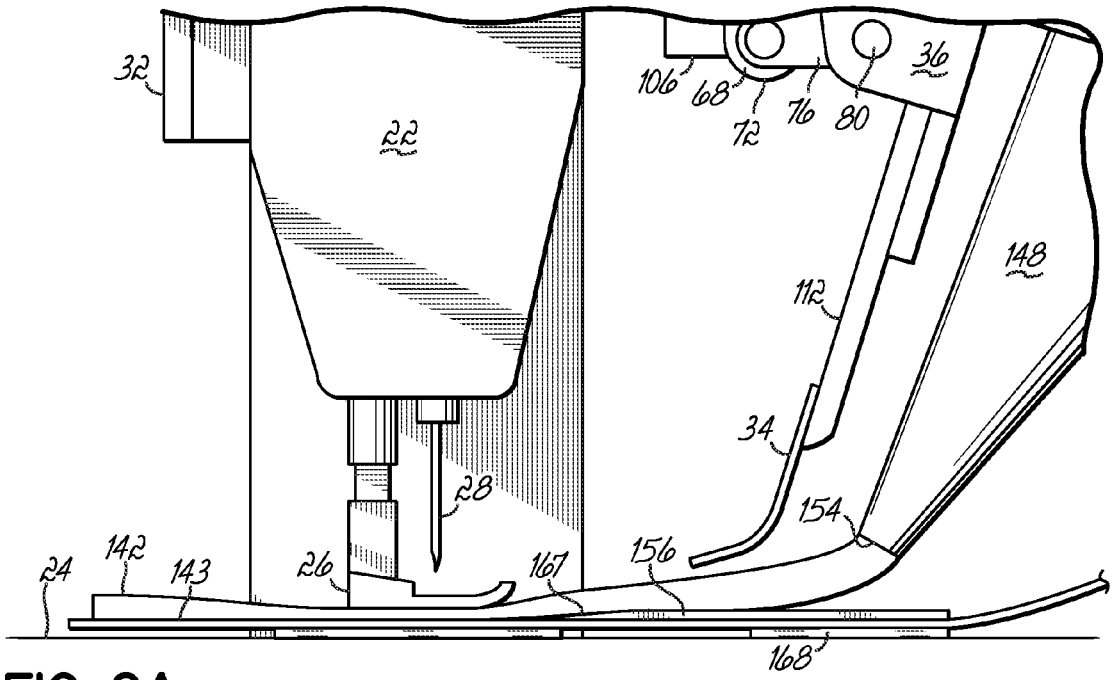
FIGS. 8A and 8B are end views of the sewing machine that illustrate the operation of the tucking attachment of FIG. 1.

Thereafter, the operator utilizes the user I/O 124 (FIG. 5) commanding the control 122 to provide an output signal to the solenoid 127 such that the tucking blade retract cylinder 120 is operated to retract the tucking blade 34. The material 150 is then manually fed through the folder 148 to form a gusset 142, and the gusset is placed beneath the presser foot 26. Thereafter, the operator again uses the user I/O 124 to command the control to advance the tucking blade 34 as shown in FIG. 8A. The tucking blade 34 is now located above the gusset 142 and on an upstream side of the presser foot 26, that is, to the right of the presser foot 26 as viewed in FIG. 6. Next, the operator commands the control 122 to turn on the sewing head motor 135 causing the upper decking panel material 143 and gusset 142 to be fed beneath the presser foot 26 from right to left, as viewed in FIG. 8A, while the needle 28 reciprocates to sew those material pieces together. As the corner 145 of the upper decking material 143 is approached, an edge of the corner 145 moves past the position feed sensor 128 (FIG. 1). The sensor 128 then detects a reflection from reflector 178; and the output of the sensor 128 changes state. Upon detecting that change of state, the tucking control 122 provides a slow feed signal via the digital I/O 132 to the sewing machine control 131. The sewing machine control 131 commands the sewing head motor 135 to decelerate to a slower feed. The edge of the corner 145 then passes below the stop sensor 129, and a reflected signal from its reflector 180 (FIG. 7) causes its output to change state. Detecting that change of state, the tucking control 122 provides a stop command to the sewing machine control 122.

Figure 9:
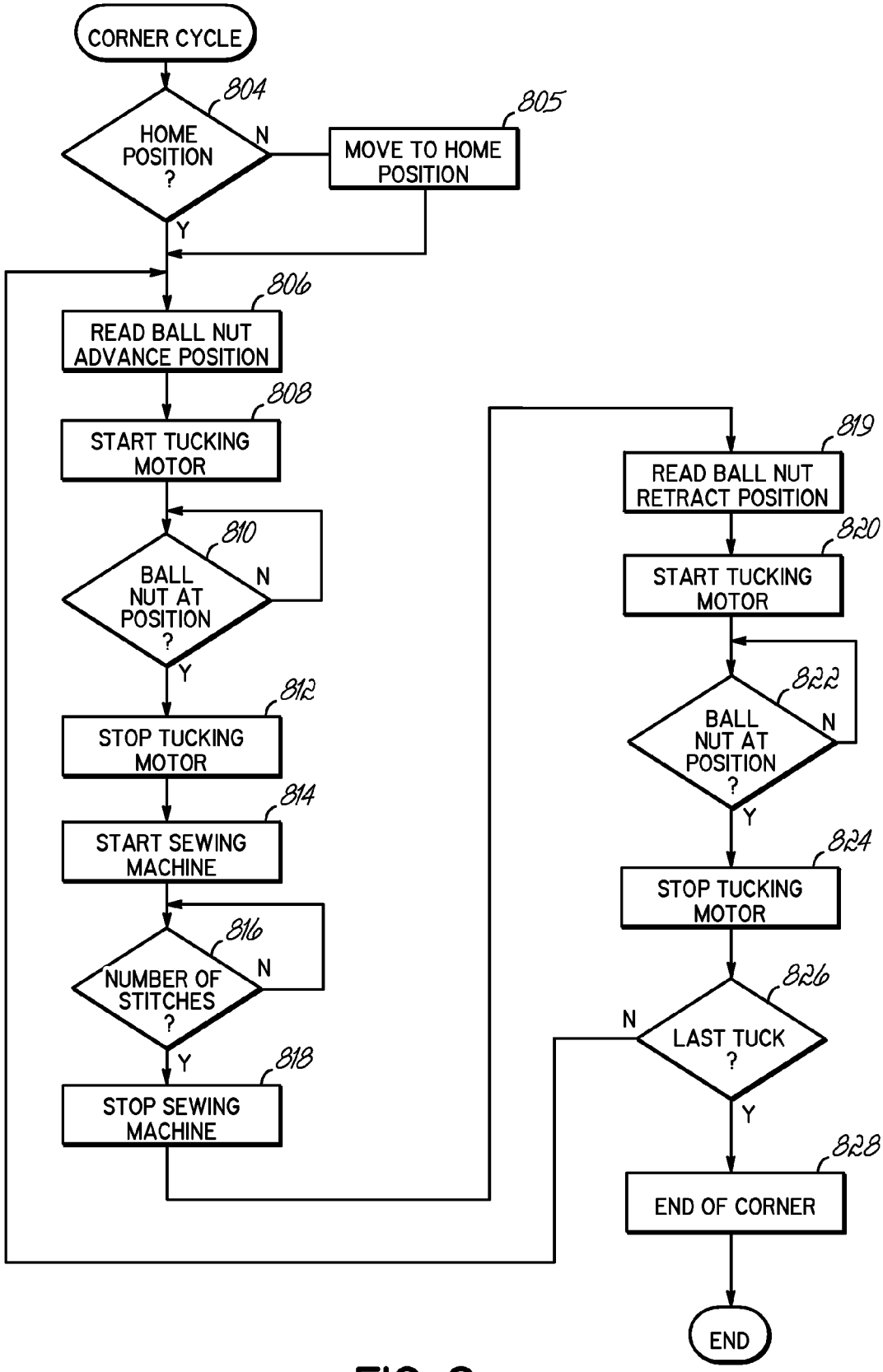
FIG. 9 is a flowchart illustrating a process of operation of the tucking attachment of FIG. 1.

The operator then presses the foot switch to 130 to command the start of a corner cycle of operation as illustrated in FIG. 9. The control 122 first determines, at 804, whether the ball nut 64 and hence, the tucking arm 36, is at its starting or home position. Normally, in executing a corner cycle, the ball nut starts from a common initial or home position, for example, referring to FIG. 2, a position closer to the blocks 60, 62 than the illustrated position of the ball nut 64. In that position, the tucking blade 34 is at its furthest position away from the presser foot 26 as shown in FIG. 1. If the control 122 determines that the ball nut 64 is not at its desired position, the control 122 provides, at 805, appropriate output signals to the tucking servomotor 46 to move the ball nut 64 to the home position.

Figure 8B:
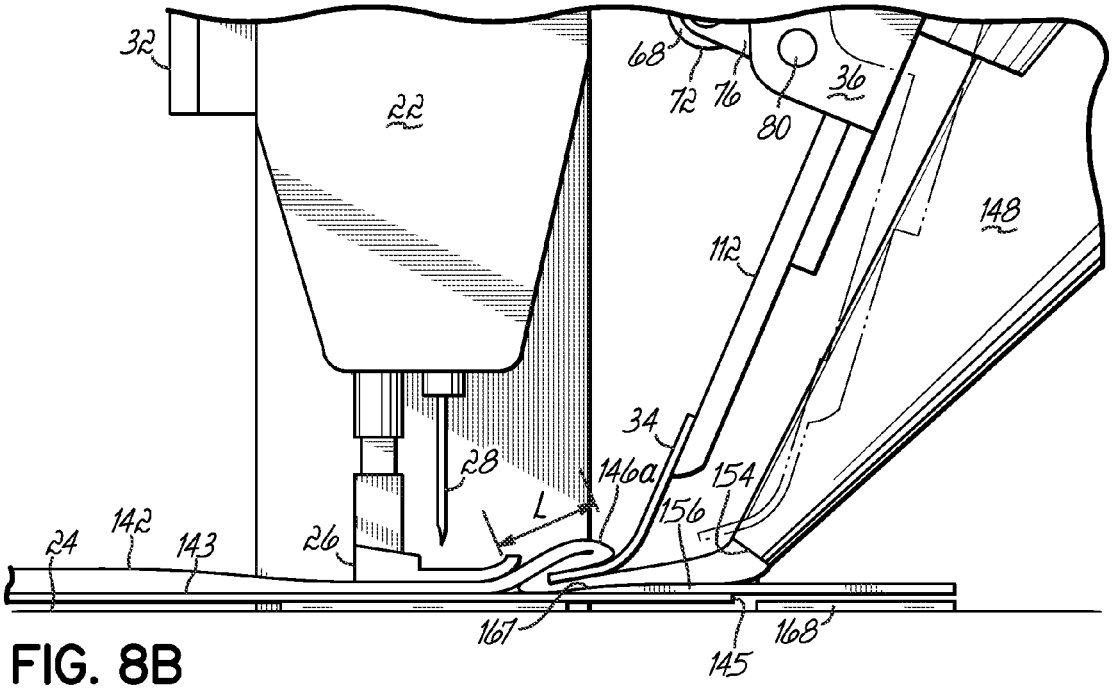

Next, at 806, the control 122 reads a ball nut advance position from the ball nut position store 137. Next, at 808, the control 122 provides output signals to the tucking blade servomotor 46 to rotate the ball screw 54 in a direction that moves the ball nut 64 outward away from the blocks 60, 62. As the ball nut 56 is moved outward, the tucking blade 34 is pivoted or advanced toward the presser foot 26. In that process, the tucking blade 34 moves gusset material 142 over the inclined surface 167 of the anvil 156; and one portion of the gusset material is placed below another portion to form a tuck 146*a* (FIG. 8B). Continued motion of the tucking blade 34 pushes the tuck below the presser foot 26 and needle 28. The distance that the ball nut 56 moves along the ball screw 54 determines the stroke length of the tucking blade 34 and hence, the length of the tuck 146*a* formed in the gusset material. The control 122 then determines, at 810, whether the ball nut has reached its desired position at which the tucking blade 34 is at its desired tuck length L. When that occurs, the control 122 then provides, at 812, a stop signal to the servomotor 46. As will be appreciated the length L of the tuck 146*a* is variable and can be changed from one tuck to another by programming and storing different ball nut positions in the ball nut position store 137.

Next, at 814, the control 122 provides a start signal to the sewing head servomotor 135 that causes the needle 28 to reciprocate and the upper decking material 143 and gusset 142 are sewn together while being fed past the needle 28. During this sewing process, the upper decking material 143 and the gusset 142 are manually guided by the operator, so that the tuck in the gusset 142 and the upper decking material 143 are being sewn together along a seam that lies on an arcuate path. The sewing machine control 131 receives feedback signals representing rotations of the sewing head servomotor 135, and those feedback signals are transferred to the tucking control 122 via the digital I/O 132. The tucking control reads the desired number of stitches to be sewn between the tucks from the number of stitches store 138. When the tucking control 122 detects, at 816, that the desired number of stitches have been sewn, the control 122 produces, at 818, a stop command to the sewing machine control 131 that then commands the sew head servomotor to stop. Thereafter, the tucking control 122 reads, at 819, a ball nut retract position from the ball nut position store and provides an output signal, at 820, commanding the tucking blade servomotor to reverse its operation and move the ball nut 64 toward its starting position. When the commanded position of the ball nut is detected, at 822, the control 122 then provides a stop command, at 824, to the tucking blade servomotor 46. The tucking control 122 then reads from the tuck number store 136 the number of tucks that are to be formed around the corner 145 and determines, at 826, whether the last tuck has been formed. If not, the process returns to read, at 806, the next ball nut position that determines the length of the next tuck to be formed.

The corner cycle then continues to automatically iterate the above-described process to successively form tucks of the same or different lengths, thereby allowing the operator to guide the gusset material 142 and sew a seam around a corner of the upper decking material 143. When the tucking control 122 detects, at 826, the formation of the last tuck, the control 122 provides and end of corner signal via the digital I/O 132 to the sewing machine control 131, which allows the operator to sew along the next straight seam by operating the sewing machine in a normal manner independent of the tucking attachment 30.

The above process is repeated to sew an edge of the gusset 142 around all four corners of the upper decking material 143, and the operator is now sewing on the starting straight seam 144 on which the sewing process was started. When approximately 6 inches of unsewn edge remains, the operator stops the sewing head servomotor 135 and raises the locking pin 96 (FIG. 2), thereby permitting the tucking attachment to be rotated 90° so that it does not interfere with the operator manually finishing the seam. At that point, the operator has access to the presser foot 26 and needle 28 and can manually tuck and sew the remaining straight edge in a known manner. If desired, the operator can obtain even more access to the sewing needle by using the user I/O 124 (FIG. 5) to command the tucking control 122 to provide an output signal switching the state of the solenoid 125. That ports pressurized fluid to the tucking blade elevate cylinders 106, 108 and causes the cylinders 106, 108 to elevate the tucking attachment 30, thereby providing additional clearance.

It should be noted that normally in a preproduction process, a number of gussets 142 are sewn to a piece of upper decking material 143 using different values for the input parameters relating to the number of tucks, the same or different lengths of respective tucks and the number of stitches between tucks. By varying those parameters, corners of appearances and styles can be created; and it is possible for a manufacturer to create a corner style that is unique to that manufacturer. After the desired values for those parameters are determined, they are entered into the tucking control 122 by means of the user I/O 124.

Figure 10:
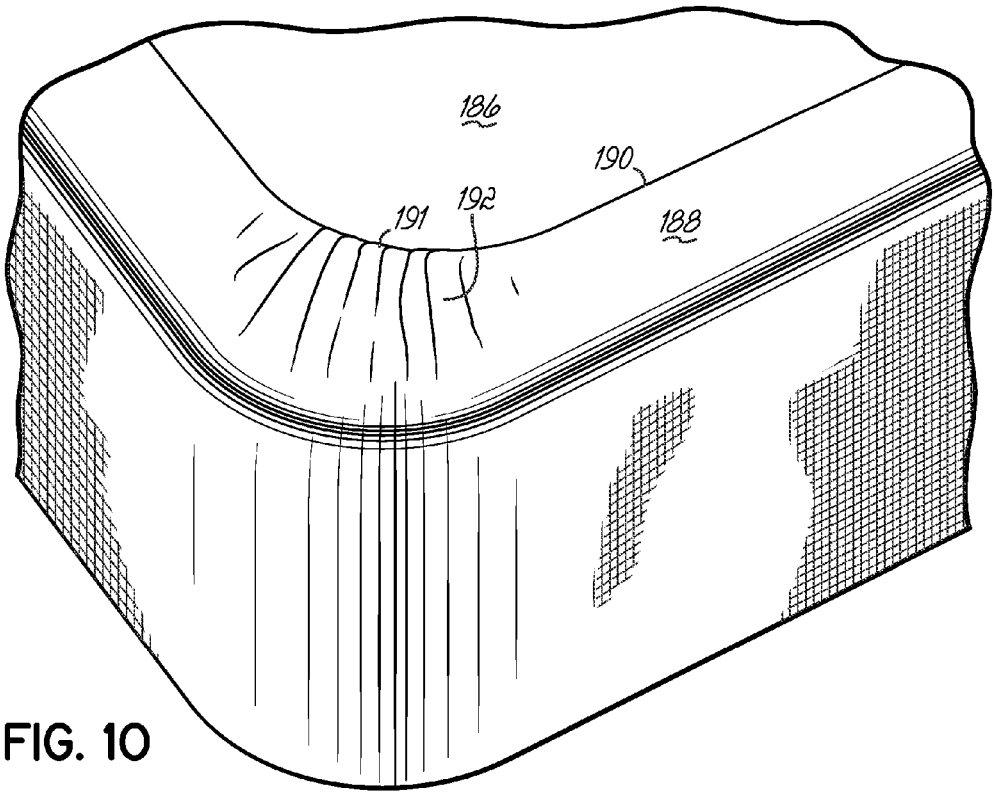
FIG. 10 is a partial perspective view of a corner of a bedding foundation representing another application for the tucking attachment of FIG. 1.

Referring to FIG. 10, in an alternative application, the tucking attachment 30 can be used to sew an upper decking material 186 to bedding foundation border material 188 that has been folded over onto the upper deck. In this application, the folder 148 can be removed from the tucking attachment 30. In this application, the upper decking material 186 is fed beneath the anvil 156 in place of the material 143. Further, the bedding foundation border material 188 is placed over the anvil 156 and below tucking blade 34 in a manner similar to that previously described with respect to the gusset material 142. The sewing machine 22 is again operated in a known manner to sew a straight seam 190 (FIG. 10). When a corner 191 is reached, the operator activates the foot switch 130 to execute the corner cycle of FIG. 9 to sew tucks 192 in the bedding foundation border material 188 in a manner as previously described.

Figure 11:
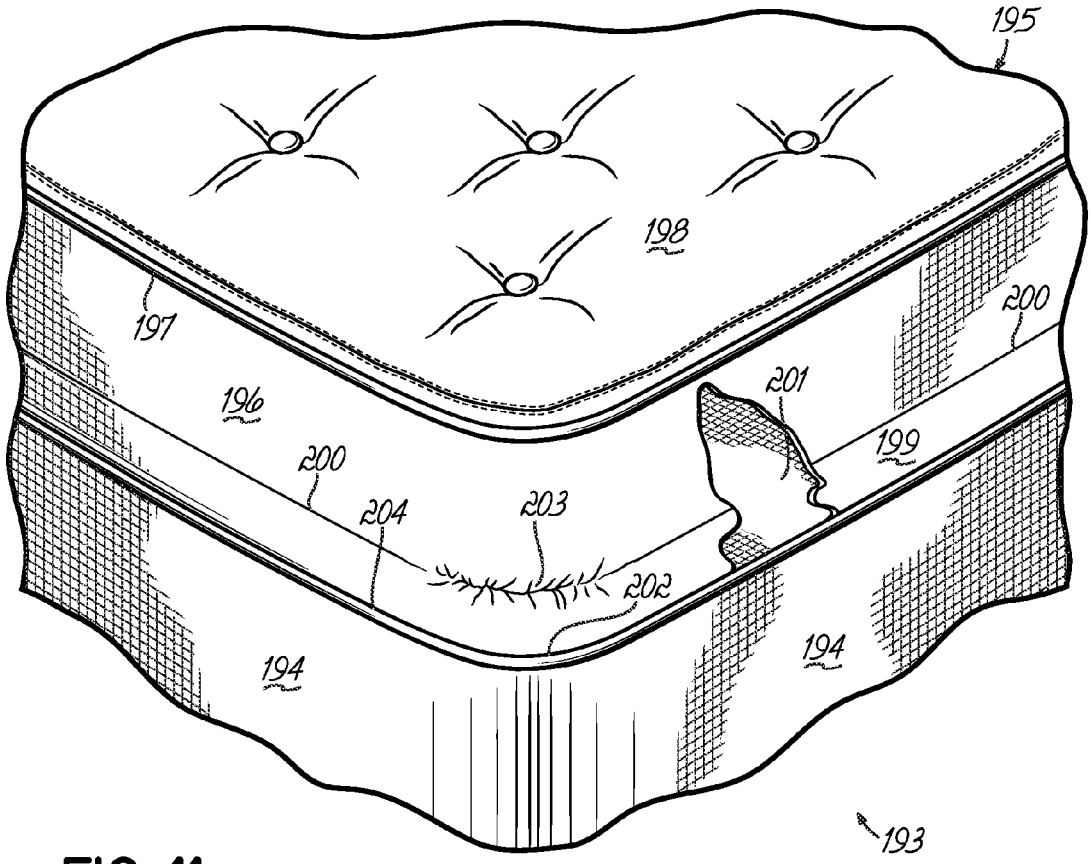
FIG. 11 is a partial perspective view of a corner of a mattress having a box top and representing a further application for the tucking attachment of FIG. 1.

Referring to FIG. 11, in a further alternative application, a mattress 193 is constructed of a body or spring assembly 194 having a Euro-top 195 attached thereto. The Euro-top 195 is normally thicker than the pillow top 141 of FIG. 6, and a Euro-top construction is often marketed with a higher premium. Various constructions of the Euro-top 195 may include a spring assembly, foam padding and/or other materials. Typically, in order to attach the Euro-top 195 to a mattress body 194, a separate gusset type of material is sewn between a peripheral edge of the Euro-top 195 and a peripheral edge of the mattress body 194 in a manner similar to that described with respect to the use of a gusset 142 (FIG. 6) to attach the pillow top 141 to the mattress body 147. However, the tucking attachment 30 of the sewing system 20 of FIG. 1 provides the capability of creating an alternative connective system.

As shown in FIG. 11, the Euro-top 195 is constructed of a border material 196 that is attached or sewn along its upper edge 197 to an outer peripheral edge of a generally planar top material 198. The lower portion of the border material 196 is formed into an integral material connector or offset 199, that in turn, is connected to the outer edge of the upper decking material 201. Thus, the border material 196 is connected to the upper decking material without requiring a separate connecting strip of material. This is achieved by first locating the upper decking material 201 over the base plate 24 (FIG. 7) and then, locating the border material 196 over the anvil 156. A lower edge 204 of the border material 196 is generally aligned with an outer edge of the decking material 201; and the materials 196, 201 are located such that the needle 28 is positioned from the lower edge 204 a distance equal to a desired width of the offset 199. A seam 200 joining the border material 196 and upper decking material 201 is started parallel to a straight edge portion of the border lower edge 204. In a manner as previously described, when a corner 202 of the upper decking material 201 is reached, a corner cycle is executed while the materials 196, 201 are guided around the corner 202. In that process, tucks 203 are formed in the border material 196 to control the fullness of the border material 196 as it is guided around the corner. The above process continues until the offset 199 is formed by the seam 200 completely around the periphery of the upper decking material 201. While the seam 200 makes it appear that the border material 196 and offset 199 are two separate pieces of material, they, in fact, are integral. Thus, the tucking attachment 30 permits a bedding manufacturer to more easily, efficiently and economically create different appearances and styles in a Euro-top style mattress construction.

The tucking attachment 30 provides a material tuck that is programmably variable in length, thereby providing great flexibility in controlling the fullness of material in sewing around a corner. Further, with the tucking attachment 30, the formation of each tuck is automatically precisely controlled, and therefore, the formation of tucks around a corner is repeatable from corner to corner. The tucking attachment 30 creates material tucks around corners with a minimum of operator intervention; and therefore, high quality material corners can be sewn without substantially increasing the manufacturing costs. The tucking attachment 30 is especially useful in joining components used to make a mattress or a bedding foundation. The capability of programming different lengths of successive tucks in sewing the corners of two components together permits a bedding manufacturer to create appearances that are different and unique to the manufacturer. Further, since an operator is not required to control the material in the formation of the individual material tucks, the operator can concentrate on overall material handling. The net result is a material tucking and sewing process that is more efficient and less stressful and tiring on the operator while producing a more consistent and higher quality product.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, in the described embodiment, the tucking blade actuator is described as a DC servomotor; however, as will be appreciated, in alternative embodiments, the tucking blade actuator can be any programmable actuator, for example, a programmable cylinder that is pneumatic, hydraulic or electric. In addition, the tucking blade actuator can also be a stepping motor or a programmable AC motor. Similarly, in other alternative embodiments, the lever lift actuator can also be implemented using any of the above-mentioned actuators.

As will be further appreciated, the mechanical linkages of the tucking blade drive can be varied and different without adversely impacting the operation of the tucking blade. Further, while in the described applications, the tucking attachment is used to make right angle corners, as will be appreciated, the tucking attachment can be used to form tucks in any arcuate or curved seam. In addition, in the described embodiment, sensors 128, 129 are used to detect the presence of a corner; however, as will be appreciated, in alternative embodiments, the presence or start of a corner can be detected by the sewing machine operator with the sensors 128, 129.

In the described embodiment, the tucking attachment 30 is shown mounted to the sewing machine 22; however, as will be appreciated, in other embodiments, the tucking attachment can be supported at its operating position by a support structure that is either suspended or free standing. Further, in its operation the tucking attachment 30 pivots the tucking blade 34 through a path that is substantially parallel to the linear direction that the sewing machine feeds the material past the needle. However, as will be appreciated, the tucking blade 34 can be operated and/or positioned such that the path of the tucking blade 34 is not substantially parallel to the linear direction that the sewing machine feeds the material past the needle. That may be desirable to form tucks having a different appearance or to provide the operator greater access to the presser foot and needle.

Therefore, the invention in its broadest aspects is not limited to the specific details shown and described. Consequently, departures may be made from the details described herein without departing from the spirit and scope of the claims which follow.

What is claimed is:

1. A method of sewing a first material supported on a base plate of a sewing machine to a second material, the sewing machine having a presser foot for holding first and second materials and a reciprocating needle for sewing the first and second materials together, the method comprising:

establishing a displacement representing a length of a tuck using a programmable control electrically connected to a motor driven shaft operable to move a tucking blade;

then, locating a first material on top of a base plate of a sewing machine beneath the presser foot;

locating an anvil plate above the first material and below the tucking blade;

locating a second material on top of the anvil plate and beneath the presser foot adjacent the first material;

operating the programmable control to advance the tucking blade toward the presser foot to engage the second material with the tucking blade and form a tuck in the second material over the first material;

operating the sewing machine to feed the tuck in the second material and the first material past the reciprocating needle and sew a desired number of stitches through the tuck in the second material and the first material;

operating the programmable control to retract the tucking blade away from the presser foot; and iterating the above steps of operating the programmable control to advance the tucking blade, operating the sewing machine and operating the programmable control to retract the tucking blade to form and sew a desired number of tucks in the second material to the first material.

2. The method of claim 1 further comprising guiding the first and second materials during the process of operating the programmable control to advance the tucking blade, operating the sewing machine and operating the programmable control to retract the tucking blade to form a seam joining the tucks in the second material to the first material along an arcuate path.

3. The method of claim 2 further comprising operating the sewing machine to feed the first and second materials past the reciprocating needle and sew the first and second materials together.

4. The method of claim 3 further comprising:

operating the sewing machine to feed the first and second materials past the reciprocating needle to form a substantially straight seam joining the first and second materials together;

guiding the first and second materials during the process of operating the programmable control to advance the tucking blade, operating the sewing machine and operating the programmable control to retract the tucking blade to form a curved seam joining the tucks in the second material to the first material; and iterating the above steps of operating the sewing machine and guiding the first and second materials to form successive straight and curved seams to form a substantially closed loop.

5. The method of claim 1 wherein the first material is an upper decking material for a mattress and the second material is a gusset material used to connect a pillow-top to the mattress.

6. The method of claim 1 wherein the first material is an upper decking material for a bedding foundation and the second material is a bedding foundation border material.

7. The method of claim 1 wherein the first material is an upper decking material for a bedding foundation and the second material is a Euro-top border material.

8. A method of using a sewing machine to sew an upper decking material of a mattress body to a border material for a mattress top, the sewing machine having a base plate, a presser foot and a reciprocating needle, the method comprising:

(a) establishing a length of a tuck using a programmable control electrically connected to a motor driven shaft operable to move a tucking blade;

(b) then, locating the upper decking material on the base plate of the sewing machine beneath the presser foot;

(c) locating a border material on top of an anvil plate supported above the base plate and beneath the presser foot adjacent the upper decking material such that the needle is located a desired distance from an edge of the border material;

(d) sewing with the sewing machine, a substantially straight seam in the border material and the upper decking material, the seam being the desired distance from, and substantially parallel to, the edge of the border material;

(e) determining that the seam is at a start of a corner of the upper decking material;

(f) operating the programmable control to cause the tucking blade to form a tuck of the length in the border material over the upper decking material;

(g) sewing a desired number of stitches through the tuck in the border material and the upper decking material with the sewing machine;

(h) manually guiding the border material and the upper decking material partially around the corner during the above steps of operating the programmable control to form a tuck and sewing a desired number of stitches;

(i) iterating the above steps (f) through (h) to form a desired number of tucks in the border material and sew a curved seam in the desired number of tucks in the border material and the upper decking material while guiding the border material and upper decking material around the corner, the seam being located at substantially the desired distance from the edge of the border material.

9. The method of claim 8 further comprising iterating steps (d) through (i) to sew a seam substantially around a periphery of the upper decking material at substantially the desired distance from the edge of the border material.

* * * * *